US005148583A

United States Patent [19]

Greenway

[11] Patent Number: 5,148,583

[45] Date of Patent: Sep. 22, 1992

[54] METHOD AND APPARATUS FOR PATTERNING OF SUBSTRATES

[75] Inventor: John M. Greenway, Spartanburg, S.C.

[73] Assignee: Milliken Research Corporation, Spartanburg, S.C.

[21] Appl. No.: 799,920

[22] Filed: Nov. 26, 1991

Related U.S. Application Data

[63] Continuation of Ser. No. 560,474, Jul. 27, 1990, abandoned, which is a continuation of Ser. No. 073,894, Jul. 14, 1987, abandoned, which is a continuation of Ser. No. 910,340, Sep. 19, 1986, abandoned, which is a continuation of Ser. No. 821,135, Jan. 22, 1986, which is a continuation of Ser. No. 731,340, May 6, 1985, abandoned, which is a continuation of Ser. No. 456,491, Jan. 7, 1938, abandoned.

[51] Int. Cl.[5] ..... D06C 29/00; D06C 23/00; D06B 1/08

[52] U.S. Cl. ..... 26/2 R; 28/163; 68/205 R

[58] Field of Search ..... 26/2 R; 28/160, 163; 68/205 R

[56] References Cited

U.S. PATENT DOCUMENTS

| | | | |
|---|---|---|---|
| 1,603,723 | 10/1926 | Stetten . | |
| 1,889,902 | 12/1932 | Moore . | |
| 2,110,118 | 3/1938 | Robertson et al. | 26/29 |
| 2,119,057 | 5/1938 | Richa | 222/51 |
| 2,241,222 | 5/1941 | Sonnino | 26/2 |
| 2,563,259 | 8/1951 | Miller | 117/9 |
| 2,723,937 | 11/1955 | Rice | 154/106 |
| 2,875,504 | 3/1959 | White | 28/72 |
| 2,988,800 | 6/1961 | White | 28/72 |
| 3,010,179 | 11/1961 | Thal | 28/72 |
| 3,153,106 | 10/1964 | Schlick | 264/78 |
| 3,171,484 | 3/1965 | Thal | 161/63 |
| 3,214,819 | 11/1965 | Guerin | 28/72.2 |
| 3,353,225 | 11/1967 | Dodson, Jr. et al. | 19/161 |
| 3,357,074 | 12/1967 | Allman et al. | 28/1 |
| 3,403,862 | 10/1968 | Dworjanyn | 239/566 |
| 3,434,188 | 3/1969 | Summers | 28/72.2 |
| 3,443,878 | 5/1969 | Weber et al. | 28/163 X |
| 3,448,501 | 6/1969 | Buzano | 28/72 |
| 3,452,412 | 7/1969 | Allman, Jr. et al. | 28/72 |

(List continued on next page.)

FOREIGN PATENT DOCUMENTS

| | | | |
|---|---|---|---|
| 766310 | 9/1971 | Belgium | D 0/6 P |
| 653805 | 12/1962 | Canada | 28/72 |
| 978452 | 12/1964 | United Kingdom | 28/163 |
| 1101899 | 1/1968 | United Kingdom . | |
| 1171543 | 11/1969 | United Kingdom . | |
| 1172289 | 11/1969 | United Kingdom . | |
| 1321236 | 3/1974 | United Kingdom . | |
| 1353183 | 5/1974 | United Kingdom . | |
| 2088424 | 6/1982 | United Kingdom . | |

*Primary Examiner*—Werner H. Schroeder
*Assistant Examiner*—John J. Calvert
*Attorney, Agent, or Firm*—Kevin M. Kercher; H. William Petry

[57] ABSTRACT

Method and apparatus for imparting visual surface effects to a relatively moving, thermally modifiable substrate by application of discrete streams of heated pressurized gas to surface areas of the substrate. The apparatus includes an elongate manifold assembly comprising two gas receiving compartments, each extending across the path of said substrate. Heated gas from the first compartment passes into the second compartment, which is comprised of a series of chambers with an elongate exit slot positioned closely adjacent the substrate surface. The gas is uniformly mixed within this second compartment, and may then be directed from the exit slot onto the substrate as a thin, continuous stream or curtain extending the length of the manifold. By use of blocking streams of relatively cool gas which deflect and dilute selected lateral segments of the heated gas stream in accordance with pattern information after the curtain of heated gas emerges from the exit slot, smaller streams or groups of streams may be formed which squarely impinge on the substrate surface and impart, via thermal modification of the surface, a selected pattern to the substrate.

11 Claims, 6 Drawing Sheets

U.S. PATENT DOCUMENTS

| | | | |
|---|---|---|---|
| 3,458,905 | 8/1969 | Dodson, Jr. et al. | 19/161 |
| 3,494,821 | 2/1970 | Evans | 161/169 |
| 3,508,308 | 4/1970 | Bunting, Jr. et al. | 28/72.2 |
| 3,585,098 | 6/1971 | Truscott et al. | 161/63 |
| 3,635,625 | 1/1972 | Voss | 425/135 |
| 3,729,784 | 5/1973 | Mazzone et al. | 26/2 R |
| 3,750,237 | 8/1973 | Kalwaites | 19/161 P |
| 3,842,468 | 10/1974 | Harrison | 28/1.4 |
| 3,916,823 | 11/1975 | Halloran | 118/63 |
| 3,969,779 | 7/1976 | Stewart, Jr. | 68/205 R X |
| 4,002,013 | 1/1977 | Johnson et al. | 57/22 |
| 4,059,880 | 11/1977 | Klein | 68/205 R X |
| 4,274,182 | 6/1981 | Greenway | 26/2 R |
| 4,312,293 | 1/1982 | Hakim | 118/697 |
| 4,323,760 | 4/1982 | Greenway et al. | 26/2 R X |
| 4,332,063 | 6/1982 | Ehrhardt | 26/3 |
| 4,364,156 | 12/1982 | Greenway et al. | 26/2 R |
| 4,393,562 | 7/1983 | Stokes | 26/2 R |
| 4,418,451 | 12/1983 | Crenshaw | 26/2 R |
| 4,499,637 | 2/1985 | Greenway | 26/2 R |
| 4,670,317 | 6/1987 | Greenway | 428/89 |

140
122
62
59
141
126
163
142
10
52
124
58
86
78
56
70
68
144
143
111
II

POLYPROPYLENE

DACRON™ POLYESTER TYPE 56 100/54 R-02 (DUPONT)

NYLON 6 (ENKA)

ORLON™ 1/24 BLEND 152 (DUPONT)

NYLON 6/6 TYPE 74S 500/92/0 (DUPONT)

ACRILAN™ (MONSANTO)

RAYON

ACETATE 70 DENIER

METHOD AND APPARATUS FOR PATTERNING OF SUBSTRATES

This application is a continuation of application Ser. No. 07/560,474, filed Jul. 27, 1990, now abandoned, which application is a continuation of Ser. No. 07/073,894, filed Jul. 14, 1987, now abandoned, which application is a continuation of application Ser. No. 06/910,340, filed Sep. 19, 1986, now abandoned, which application is a continuation of application Ser. No. 07/821,135, filed Jun. 22, 1986, now abandoned, which applied is a continuation Ser. No. 06/731,340, filed May 6, 1985, abandoned, which application is a continuation of application Ser. No. 06/456,491, filed Jan. 7, 1983, also abandoned.

This invention relates to a method and apparatus for pressurized heated fluid stream treatment of relatively moving substrate materials. In a particular embodiment, this invention relates to a method and apparatus for selectively applying streams of heated air to a thermally modifiable substrate to impart a visual change in the substrate surface, especially a pattern effect having a relatively high apparent resolution.

Methods and devices of the prior art disclose techniques for imparting a pattern on fabric by means of directing one or more streams of heated air onto relatively moving, thermally modifiable substrates such as textile fabrics comprising thermoplastic fibers. Some contributors have relied upon stencils and masks placed between a source of heated air and the substrate surface to generate the requisite pattern-wide impingement of air streams on the substrate. Generally speaking, a major problem with stencil and mask systems, such as that disclosed in Belgian Patent no. 766,310, to Kratz, et al., has been the limitation imposed upon the process by the necessity of having a mechanical stencil or mask, interposed between the heated air source and substrate, which must map exactly every detail of the pattern, regardless of how delicate or complex or extensive the pattern may be. Having to generate, maintain, and position accurately a stencil having a highly intricate pattern is extremely difficult in a commercial, production environment. An additional problem with such systems, moreover, is a general inability to generate patterns in which untreated areas are completely surrounded by treated areas, e.g., a closed, treated boundary both surrounding and surrounded by untreated areas.

Other contributors to this art have relied upon various nozzles or pre-formed jets to form and direct the streams of heated air which strike the substrate surface.

Systems using pre-formed jets, such as those disclosed in U.S. Pat. No. 3,613,186 to Mazzone, et al., U.S. Pat. No. 3,256,581, to Thal, et al., and U.S. Pat. No. 3,774,272 to Rubaschek, et al., are generally limited to patterning a substrate with an array of grooves arranged in relatively simple patterns—usually merely continuous grooves extending generally along the direction of substrate movement.

U.S. Pat. No. 4,364,156 to Greenway, et al. discloses a system wherein pressurized heated fluid or gas, for example, air, may be distributed along a slot which extends the length of an elongate manifold. The air is formed into a series of thin, individual streams within the manifold, before the air exits from the elongate manifold slot. These systems are adaptable for use with a flat, comb-like slotted shim plate which may be inserted within the slot, with the individual slots in the shim plate oriented parallel to the flow of fluid through the elongate manifold slot, for the purpose of forming a series of individual streams. Each slot may have a source of transversely directed blocking fluid associated with it. Streams of blocking fluid, e.g., relatively cool air, may then be used to block selectively the flow of selected ones of the individual streams formed by the slots in the shim plate before the blocked stream leaves the manifold. Alternatively, the required series of individual streams may be formed without the use of such shim plate simply by selectively directing, again from within the manifold, streams of blocking fluid, e.g., relatively cool air, across the gap formed by the elongate manifold slot at selected locations along the length of the manifold, thereby blocking portions of the thin curtain or blade of heated air generated by the elongate manifold before the curtain or blade of heated air exits from the manifold slot. Such a system is more completely described in U.S. Pat. application Ser. No. 282,330, filed Jul. 10, 1981, now U.S. Pat. No. 4,471,514.

By using an array of aligned, transverse blocking streams or jets of relatively cool air to generate, within the manifold, a plurality of selectively positioned heated air streams from a single elongate heated air stream without the use of a shim plate, extreme versatility, speed, and reproducibility are achieved, and patterns incorporating untreated areas having closed, treated boundary lines, as well as extended line segments which are substantially perpendicular to the direction of substrate travel, are possible. However, it has been found that where extreme detail and pattern resolution are desired, the transverse blocking air jet system discussed above is not totally satisfactory. Efforts to develop a system in which the transverse air streams within the manifold slot are aligned and spaced along the length of the manifold as closely as, for example, 20 per linear inch, allowing for the selective blocking of the curtain of heated air at any of 20 pre-determined locations along any one inch working segment of the manifold slot, have not been entirely satisfactory. When such density is attempted, it is believed fluid mechanical effects within the slot, perhaps as a result of mutual interference between adjacent blocking jets, cause the blocking effect to spread or diffuse, so that the blocking effect extends over a larger segment of the slot length than is desired, and the appearance of the resulting pattern is degraded. This disadvantageous effect is particularly dramatic where, for example, among a group of three adjacent blocking jets, the pattern requires the first and third blocking jets to block portions of the heated air stream, and requires the second blocking jet to remain off, thereby permitting a single thin stream of heated air, having a width approximately equal to the region which would be blocked by the second jet acting alone, to squarely strike the substrate. Under this circumstance, the blocking effect of the activated first and third jets tends to encroach into the heated air stream segment controlled by the second jet, causing a kind of pinching effect which tends to attenuate or block the heated air stream segment in the region of the second jet when no such attenuation or blocking is desired.

It has been discovered that, if blocking jets are to be arranged in a relatively high density, aligned configuration, for example, at least about fifteen to twenty jets per linear inch, the disadvantages discussed above can be substantially eliminated if segments of the pressurized heated air stream are not blocked within the elongate manifold, but rather diverted and diluted after, preferably immediately after, the intact elongate heated air stream exits the slot in the elongate manifold. This can be accomplished if, for example, an array of air jets is positioned immediately outside of the slot in the manifold so as to dilute and divert from the substrate surface precisely defined segments of selectable length from the substantially continuous elongate stream or curtain of pressurized heated air which exits from the manifold slot, while not disturbing the paths of other precisely defined segments of the elongate heated air stream or curtain which are directed at precisely pre-determined areas on the relatively moving substrate surface.

Details of this invention, together with the accompanying drawings, are discussed in the following detailed description, in which.

Figure 1:
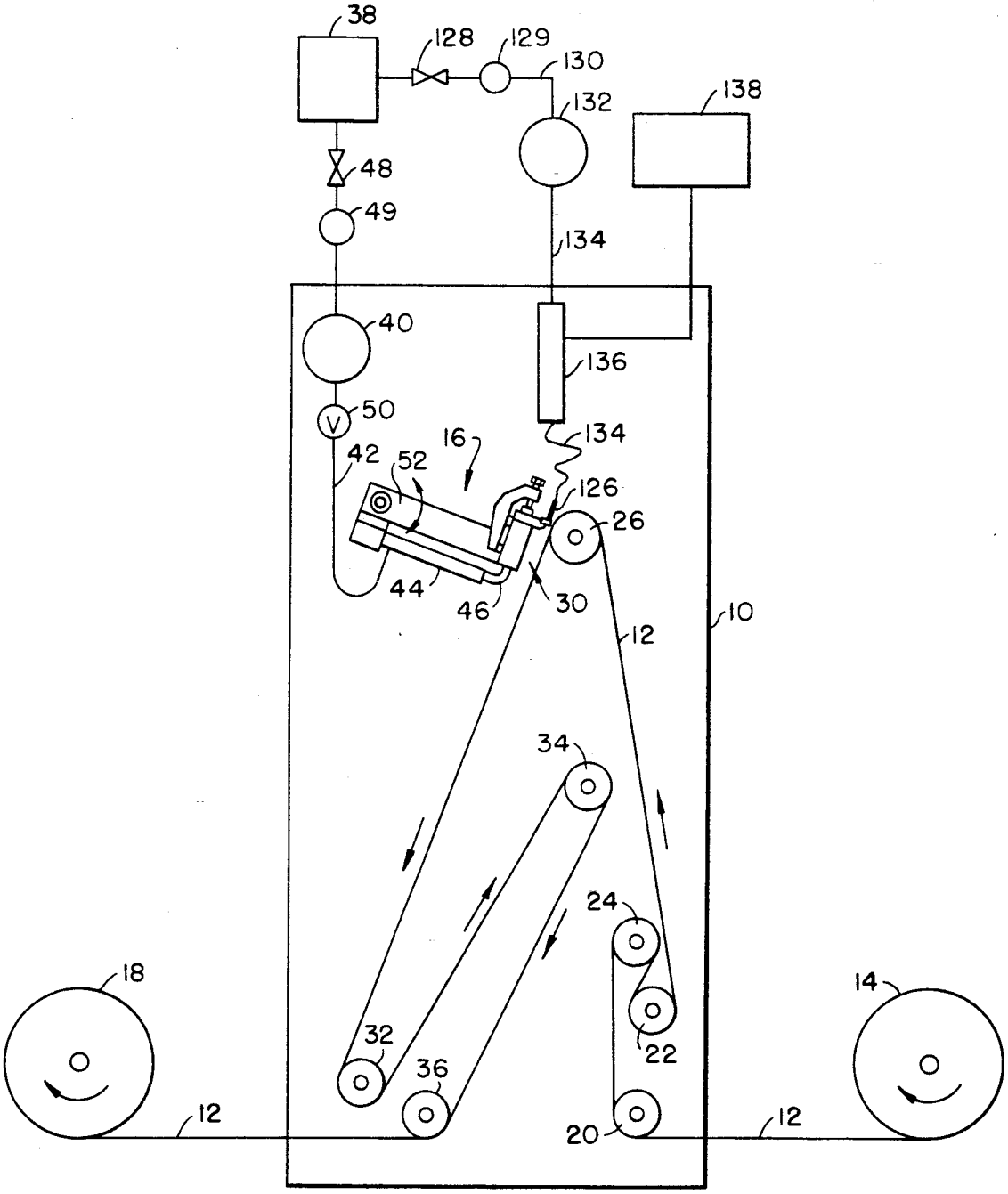
FIG. 1 is a schematic side elevation view of apparatus for pressurized heated fluid stream treatment of a moving substrate material to impart a surface pattern or change in the surface appearance thereof, and incorporating novel features of the present invention.

Referring more specifically to the drawings, FIG. 1 shows, diagrammatically, an overall side elevation view of apparatus for pressurized heated fluid stream treatment of a moving substrate material to impart a high resolution pattern or visual change thereto. As seen, the apparatus includes a main support frame including end frame support members, one of which, 10, is illustrated in FIG. 1. Suitably rotatably mounted on the end support members of the frame are a plurality of substrate guide rolls which direct an indefinite length substrate material, such as a textile fabric 12, from a fabric supply roll 14, past a pressurized heated fluid treating unit, generally indicated at 16. After treatment, the fabric may be collected in a continuous manner on a take-up roll 18. As shown, fabric 12 from a supply roll 14 passes over an idler roll 20 and is fed by a pair of driven rolls 22, 24 to a main drive fabric support roll 26, whereby the surface of the fabric is passed closely adjacent the heated fluid discharge outlet of an elongate fluid distributing manifold assembly 30 of treating unit 16. The treated fabric 12 thereafter passes over a series of driven guide rolls 32, 34 and an idler roll 36 to take up roll 18 for collection. For purposes of discussion, the following discussion will assume air is the preferred fluid. It should be understood, however, that other fluids may be used.

As illustrated in FIG. 1, fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of manifold assembly 30 and supply heated pressurized air thereto through short, individual air supply lines, indicated at 46, which communicate with assembly 30 uniformly along its full length. Air supply to the fluid distributing manifold assembly is controlled by a master control valve 48, pressure regulator valve 49, and individual precision control valves, such as needle valves 50, located in each heater air supply line 42. The heaters are controlled in suitable manner, as by temperature sensing means located in the outlet lines 46 of each heater, with regulation of air flow and electrical power to each of the heaters to maintain the heated air at a uniform temperature and pressure as it passes into the manifold assembly along its full length. Typically, for patterning textile fabrics such as pile fabrics containing thermoplastic pile yarns, the heaters are employed to heat air exiting the heaters and entering the manifold assembly to a uniform temperature of about 700° F.-800° F. or more.

The heated fluid distributing manifold assembly 30 is disposed across the full width of the path of movement of the fabric and closely adjacent the surface thereof to be treated. Typical surface spacing is 0.010 to 0.020 inch. Although the length of the manifold assembly may vary, typically in the treatment of textile fabric materials, the length of the manifold assembly may be 76 inches or more to accommodate fabrics of up to about 72 inches in width.

Figures 7, 8:
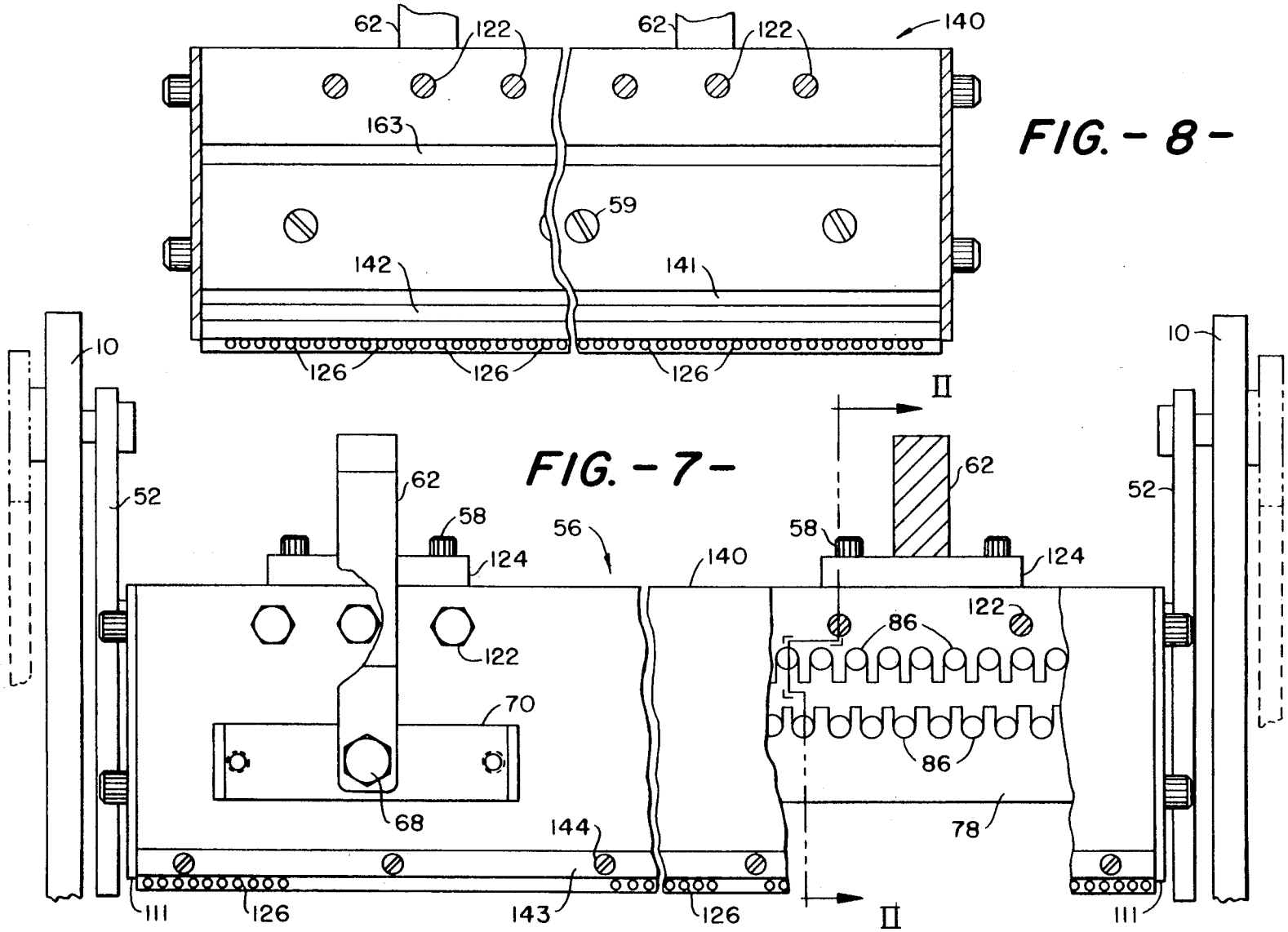
FIG. 7 is an enlarged plan view, in partial section, of end portions of the manifold assembly, taken generally along line VII—VII of FIG. 2 (i.e., above the manifold assembly and looking in the direction of the arrows.
FIG. 8 is an enlarged plan view of end portions of the manifold assembly, taken generally along line VIII—VIII of FIG. 5 and looking in the direction of the arrows.

As illustrated in FIG. 1 and in FIG. 7, the elongate manifold assembly 30 and the bank of heaters 44 are supported at their ends on the end frame support members 10 of the main support frame by support arms 52 which are pivotally attached to end members 10 to permit movement of the assembly 30 and heaters 44 away from the surface of the fabric 12 and fabric supporting roller 26 during periods when the movement of the fabric through the treating apparatus may be stopped.

Figure 2:
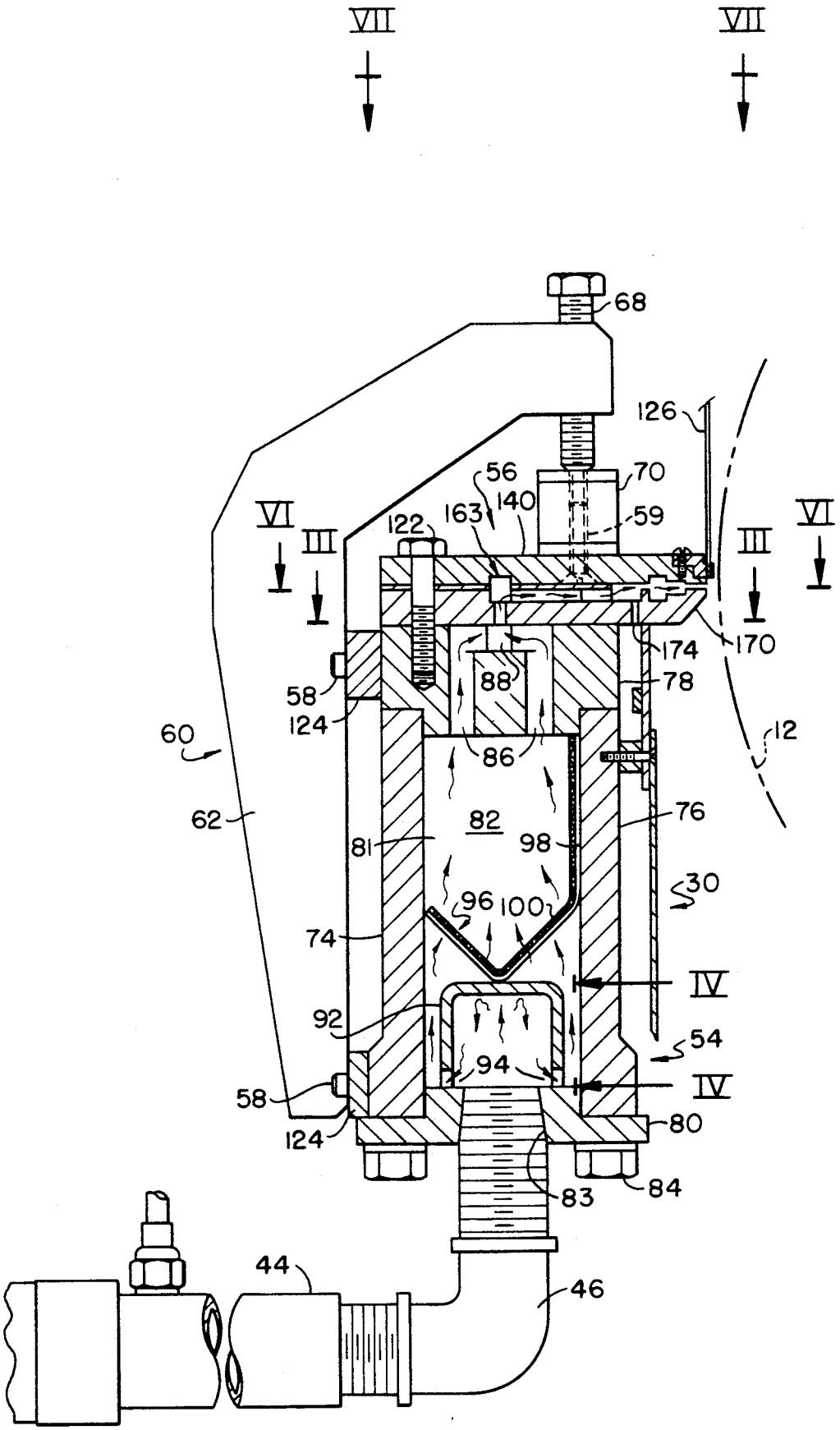
FIG. 2 is an enlarged partial sectional view of the fluid distributing manifold assembly of the apparatus of FIG. 1, taken along a section line of the manifold assembly indicated by the line II—II in FIG. 7.

Details of the heated fluid distributing manifold assembly may be best described by reference to FIGS. 2–7 of the drawings. As seen in FIG. 2, which is a partial sectional elevation view through the assembly, taken along line II—II of FIG. 7, the manifold assembly 30 comprises a first large elongate manifold housing 54 and a second smaller elongate manifold housing 56 secured in fluid tight relationship therewith by a plurality of spaced clamping means. The manifold housings 54, 56 extend across the full width of the fabric 12 adjacent its path of movement. A plurality of manually-operated clamps 60 are spaced along the length of the housings. Each clamp includes a portion 62 fixedly attached, as by spaced bolts 58 and brackets 124, to side wall 74 of the first manifold housing 54, as well as an adjustable threaded screw assembly 68 with elongate presser bars 70 which apply pressure to manifold housing 56. Screws 59 may be used to secure presser bars 70 to the top surface of upper wall member 140 of housing 56.

As best seen in FIG. 2, first elongate manifold housing 54 is of generally rectangular cross-sectional shape, and includes a pair of spaced plates forming side walls 74, 76 which extend across the full width of the path of fabric movement, and elongate top and bottom wall plates 78, 80 which define a first elongate fluid receiving compartment 81, the ends of which are sealed by end wall plates 82 suitably bolted thereto. Communicating with bottom wall plate 80 through fluid inlet openings 83 (FIG. 4) spaced uniformly therealong are the heated air supply lines 46 from each of the electrical heaters 44. The side walls 74, 76 of the housing are connected to top wall plate 78 in suitable manner, as by welding, and the bottom wall plate 80 is removably attached to side walls 74, 76 by bolts 84 to permit access to the first fluid receiving compartment 81. The plates and walls of the housing 54 may be formed of suitable high strength material, such as stainless steel or the like.

The manifold housing 54, 56 are constructed and arranged so that the flow path of fluid through the first housing 54 is generally at a right angle to the discharge axes of the fluid stream outlets of the second manifold housing 56. In addition, the mass comprising side walls 74, 76 and top and bottom wall plates 78, 80 of first manifold housing 54 is substantially symmetrically arranged on opposing side of a plane bisecting the first fluid receiving compartment 81 in a direction parallel to the elongate length of manifold housing 54 and parallel to the predominant direction of fluid flow, i.e., from inlet openings 83 to passageways 86, through the housing compartment 81. Because the mass of the first housing 54 is arranged in a generally symmetrical fashion with respect to the path of the heated fluid through the housing compartment 81, thermal gradients and the resulting thermally-induced distortions in the first housing 54 also tend to be similarly symmetrical. As a consequence, any distortion of the manifold assembly caused by expansion and contraction due to temperature differentials tends to be resolved in a plane generally parallel to the surface of the textile fabric 12 being contacted by the heated fluid streams. This resolution of movement of the manifold assembly minimizes any displacement of the manifold discharge outlet channels 115 (FIG. 5) toward or away from the fabric 12 as a result of non-uniform thermal expansion of the manifold assembly. Any remaining unresolved thermally-induced displacement of the manifold housing 54 may be corrected by use of jacking members or other means to supply corrective forces directly to the manifold housing.

Figure 3:
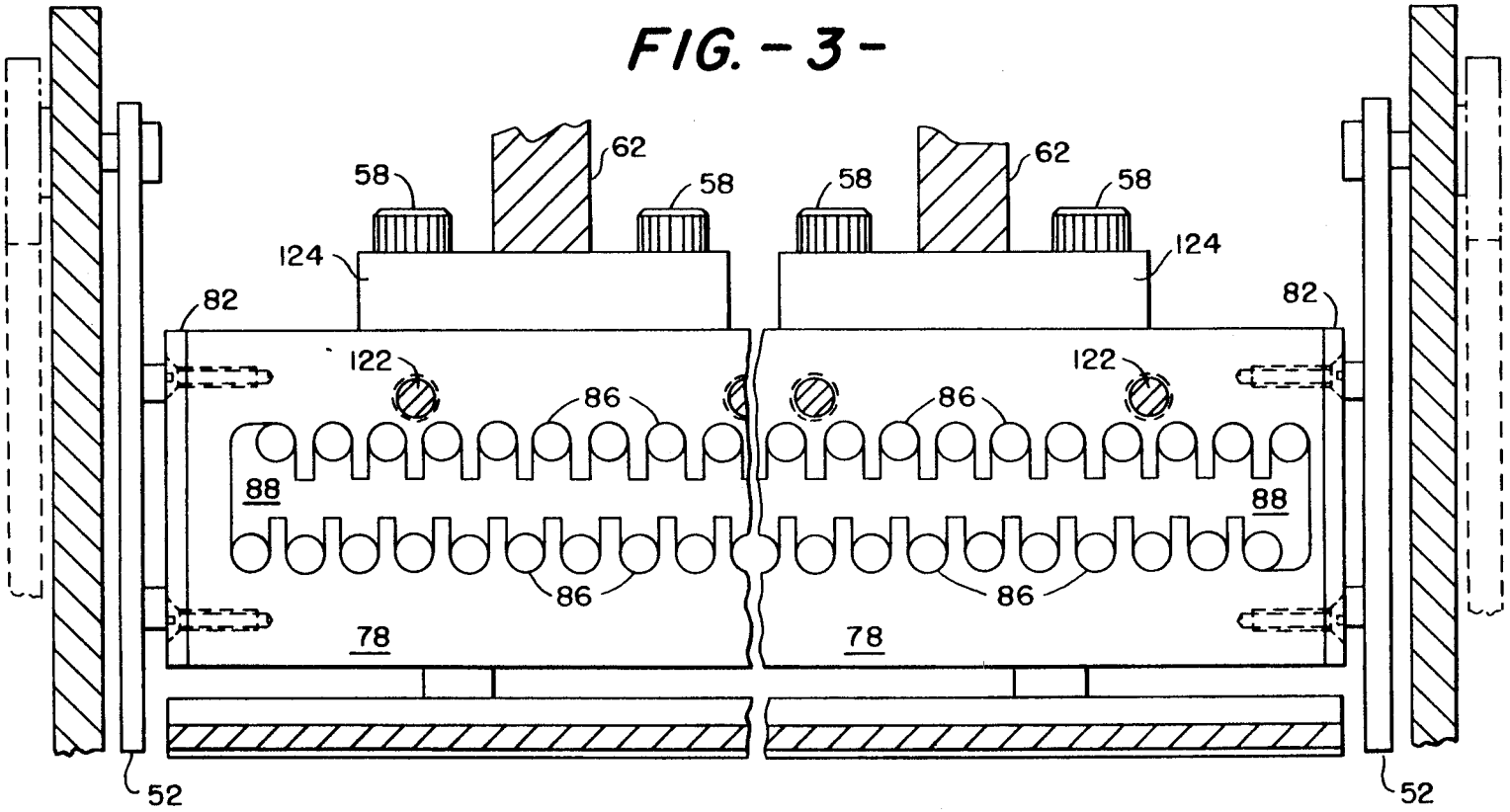
FIG. 3 is an enlarged sectional view of the elongate manifold assembly, taken generally along line III—III of FIG. 2 and looking in the direction of the arrows.

As best seen in FIGS. 2, 3, and 7, upper wall plate 78 of manifold housing 54 is of relatively thick construction and is provided with a plurality of fluid flow passageways 86 which are disposed in uniformly spaced relation along the plate in two rows to communicate the first fluid receiving compartment 81 with a central elongate channel 88 in the outer face of plate 78 which extends between the passageways along the length of plate 78. As seen in FIGS. 3 and 7, the passageways in one row are located in staggered, spaced relation to the passageways in the other row to provide for uniform distribution of pressurized air into the central channel 88 while minimizing strength loss of the elongate plate 78 in the overall manifold assembly.

Figure 4:
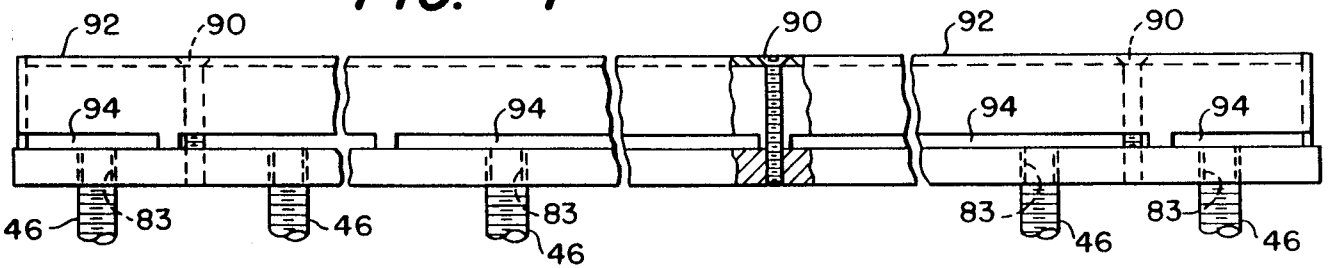
FIG. 4 is an enlarged side elevation view of end portions of the elongate baffle member of the manifold assembly, looking in the direction of arrows IV—IV of FIG. 2.

As seen in FIGS. 2 and 4, located in first fluid receiving compartment 81 and attached to the bottom wall plate 80 of the housing 54 by threaded bolts 90 is an elongate channel-shaped baffle plate 92 which extends along the length of the compartment 81 in overlying relation to wall plate 80 and the spaced, fluid inlet openings 83. Baffle plate 92 serves to define a fluid receiving chamber in the compartment 81 having side openings or slots 94 adjacent wall plate 80 to direct the incoming heated air from the bank of heaters in a generally reversing path of flow through compartment 81. As seen in FIG. 2, disposed above channel-shaped baffle plate 92 in compartment 81 between the fluid inlet openings 83 and fluid outlet passageways 86 is an elongate filter member 96 which consists of a perforated, generally J-shaped plate 98 with filter screen 100 disposed thereabout. Filter member 96 extends the length of the first fluid receiving compartment 81 and serves to filter foreign particles from the heated pressurized air during its passage therethrough. Access to the compartment 81 by way of removable bottom wall plate 80 permits periodic cleaning and/or replacement of the filter member, and the filter member 96 is maintained in position in the compartment 81 by frictional engagement with the side walls 74, 76 to permit its quick removal from and replacement in the compartment 81.

Figure 5:
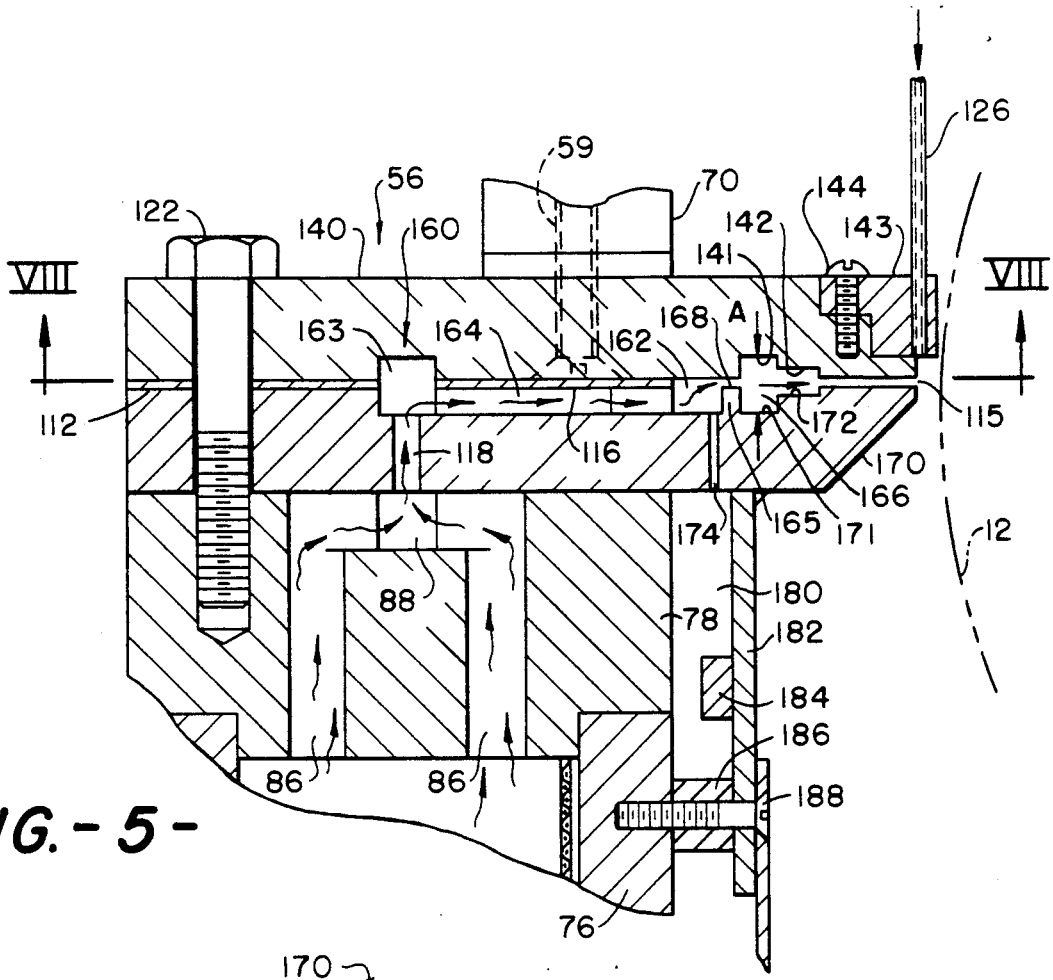
FIG. 5 is an enlarged broken away sectional view of the fluid stream distributing manifold housing portion of the manifold assembly as illustrated in FIG. 2.

As best shown in FIG. 2 and 5, a second smaller manifold housing 56 comprises first and second opposed elongate wall members 140 and 170. When disposed as shown, in spaced, coextensive, parallel relation, members 140 and 170 form a second fluid receiving compartment, shown generally in FIG. 5 at 160, which serves to divert the air at a right angle, and further serves to form the air into a long, relatively thin curtain or blade which extends the full width of wall members 140, 170, and which is uniform with respect to temperature, pressure, and velocity.

In order to selectively interrupt continuously selectable, precisely defined lateral segments of this thin, continuous curtain or blade of pressurized heated air and prevent the pressurized heated air from striking the surface of closely spaced substrate 12 within such segments, and at the same time present substantially no interruption or modification to the heated air in all remaining, complementary segments along the length of this curtain or blade of air, a uniform array of tubes 126 is positioned immediately outside the forward-most portion of wall member 140. Tubes 126 are positioned to divert the path of a precisely defined segment of the continuous curtain of air in a direction such that the diverted segment will not impinge directly upon the substrate surface to any significant degree, but will instead be directed in a plane approximately perpendicular to the plane defined by the path of those segments of the curtain or blade which are undiverted and which are intended to squarely strike the substrate surface. Dilution of these diverted segments also takes place, which lowers the temperature of these segments as well. In this way, the lateral configuration of the blade of air striking the substrate can be controlled, and pattern information may be imparted to the substrate surface, i.e., the curtain of air originating within compartment 160 may be reduced to one or more discrete, narrow streams of air which strike the substrate squarely, while those diverted segments of the curtain strike the substrate either obliquely or not at all, and are in either case relatively cooler than the undiverted segments, due to the diluting effects of the diverting air streams, and therefore have relatively little or no permanent effect on the substrate.

Figure 6:
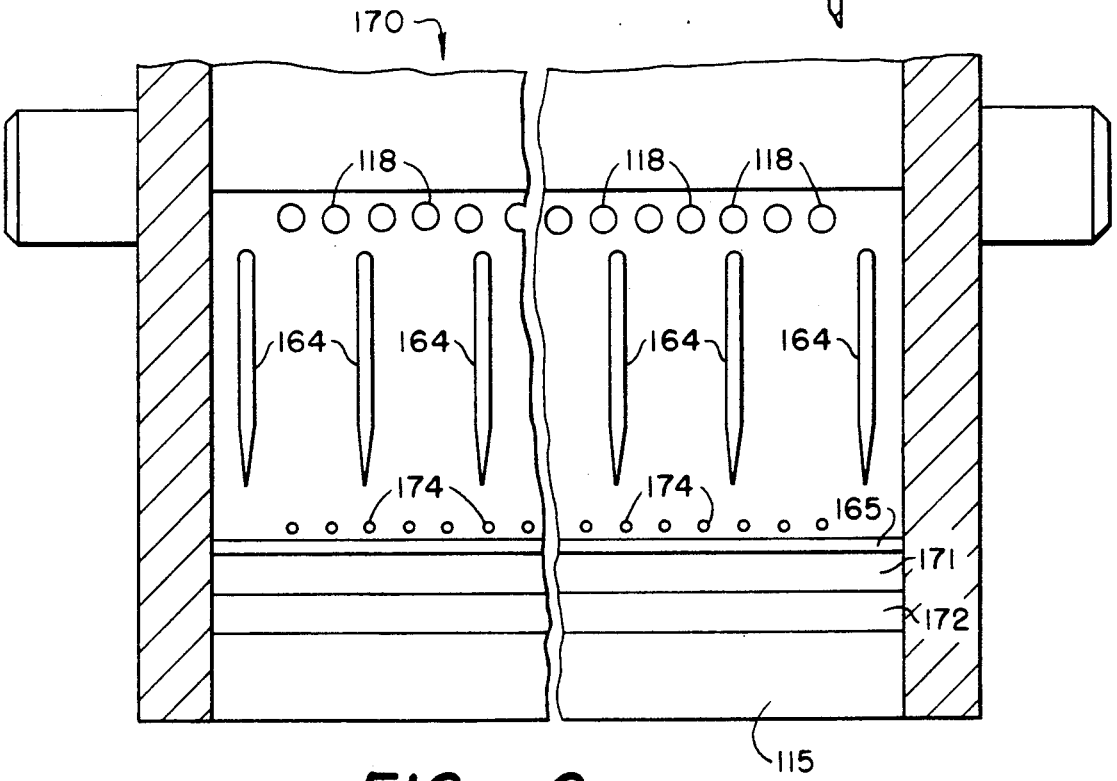
FIG. 6 is an enlarged, schematicized plan view of end portions of the fluid stream distributing manifold housing looking in the direction of the arrows VI—VI of FIG. 2.

FIGS. 5 and 6 disclose the details of second fluid receiving compartment 160, the ends of which are closed by end plates 111 (FIG. 7). Compartment 160 may be thought of as two chambers 162, 166 in serial arrangement, each compartment extending the length of manifold housing 56, and each chamber being followed by a throttling orifice comprising a relatively thin slot 168, 115 of individually uniform but not necessarily equal gap width extending the length of compartment 160. Heated air which has been mixed in first manifold compartment 81 enters second fluid receiving compartment 160 at a pressure of from about 0.1 to about 5 p.s.i.g. or more by way of a plurality of individual fluid inlets 118 which communicate with elongate channel 88 of the first manifold housing 54 along its length. Gallery 163 within chamber 162 serves to mix the air from individual inlets 118, whereupon the air flows into the remaining portion of chamber 162. In this remaining portion of chamber 162, the air is made to flow the width of the chamber, thereby mixing with air already present in the chamber. Support partitions 164 act as load bearing and separating members between wall members 140 and 170. As can be seen in FIG. 6, partitions 164 have rounded and portions, straight sides, and are tapered (included angle approximately 14°) to a point having a radius of approximately 0.01 inch. This is done primarily to avoid causing turbulence in the fluid flow path within this portion of chamber 162. It is foreseen that other turbulence-minimizing configurations for support partitions 164 are possible.

At the forward end of chamber 162, ridge or weir 165 is used to define slot 168, which acts as a throttling orifice between chamber 162 and adjoining chamber 166. By passing through slot 168, which forms a uniform gap extending the length of wall members 140, 170, a reduction in fluid pressure is effected which allows chamber 166 to act as an expansion chamber. By expanding, the fluid in chamber 166 tends to become uniform with respect to temperature, velocity, and pressure. Chamber 166 can be thought of as the immediate reservoir from which air is formed into a blade-like exit stream via discharge slot 115. Wall segments 141, 142 and 171, 172 merely serve to define a transition area between chamber 166 and discharge slot 115 which does not generate substantial entrance effects. Rough edges within chamber 166 or within this transition area should be avoided. It is foreseeable that other configurations for chamber 166, such as forming the walls of chamber 166 in an appropriate curve, would further minimize entrance effects, but such curves are generally expensive to machine, and have been found to be unnecessary in this embodiment in most applications. It is suggested, however, that regardless of the chamber cross-sectional shape, the maximum ratio of chamber height (dimension "A" in FIG. 5) to the height or gap of slot 168 should be on the order of 10 or more, and preferably 14 or 16 or more. It is estimated that the overall effect of slot 168, expansion chamber 166, and discharge slot 115 is to introduce a dynamic head loss on the order of 4.0 with respect to air in chamber 162. It has been found that dynamic head losses of at least 3.0 are most suited to generating the uniform flow desired. Dynamic head losses of about 4.0 or more are recommended for most purposes, as this amount of dynamic head loss is usually sufficient to assure a practically uniform fluid stream emerging from discharge outlet 115. Discharge slot 115 is formed from opposing flat surfaces on the forward portion of wall members 140, 170, and is also of some uniform gap height all along the length of members 140, 170. Where a discharge slot gap height (i.e., measured parallel to dimension "A") of about 0.018 inch is used, a discharge slot depth (i.e., measured in the direction of fluid flow) of about 0.38 has been found advantageous.

It should be noted that, due to the design of elongate wall members 140 and 170, machining of said wall members may be relatively simple. The load bearing surfaces of wall members 140, 170 may be smoothly machined in a single operation to ensure a fluid tight seal for chambers 162, 166. The lower surface of wall member 140, forming the upper wall portion of discharge slot 115, the upper wall portion of slot 168, and the upper load bearing surfaces above chamber 162 and to the rear of gallery 163, may be made co-planar. Similarly, those portions of wall portion 170 defining the lower load bearing surfaces to the rear of gallery 163, the load bearing surfaces atop support partitions 164, the upper surface of ridge 165 defining slot 168, and the lower wall portion of discharge slot 115 may all be co-planar. The lower surface of wall member 140 may be machined by cutting channels corresponding to the upper portion of gallery 163 and wall segments 141, 142 comprising the upper portions of chamber 166, and similar appropriate machining may be used to form the lower portions of gallery 163, chamber 162, and the lower wall members 171, 172 comprising the lower portions of chamber 166.

In addition to simplifying greatly the fabrication of wall members 140 and 170, this design also allows the gap width of discharge slot 115, as well as the gap width of slot 168, to be set merely by inserting flat, rectangular spacer shims 112, 116 of equal thickness between the mating wall members 140, 170, as shown in FIG. 5. This allows for simple, quick adjustment of the gap size of discharge slot 115 in response to requirements imposed by changes in substrate material or visual effect desired. It is foreseen that shim thicknesses ranging from 0.005 inch or less to 0.035 inch or more may be used. It is believed the exact dimensional relationship which this design imposes is not important to the operation of the manifold compartment 160. Thus, for example, it is foreseen that throttling slot 168 need not have the same gap size as discharge slot 115. The depth of discharge slot 115 may require adjustment at extreme gap sizes in order to prevent turbulence within the slot 115.

Lower wall member 170 of the second manifold housing 56 is provided with a plurality of fluid inlet openings 118 which communicate with the elongate channel 88 of the first manifold housing 54 along its length to receive pressurized heated air from the first manifold housing 54 into the second fluid receiving compartment 160. Wall members 140, 170 of the second manifold housing 56 are maintained in fluid tight relation with spacing shim members 112, 116 and with the elongate channel 88 of the first manifold housing 54 by clamps 60, as well as by bolts 122 which may extend through wall member 140 and into wall member 170, or may extend through wall members 140, 170 and into wall plate 78. Because of the cantilevered design of housing 56, it is advantageous to align presser bar 70 with the forward portion of support partitions 164.

As shown in FIGS. 2 and 5, the forward portion of wall member 170 carries vents 174 which allow a small quantity of heated air to be bled from chamber 162, thereby assuring a small but steady flow of air through chamber 162. Such flow not only prevents the build-up of stagnant, heated air within chamber 162, thereby causing uneven temperature distribution within compartment 160, but also assists in preventing excessive heat build-up in the vicinity of the heater elements 44 and premature heater burn-out. An additional advantage is that the passage of the heated bleed air throught vents 174 in lower wall member 170 serves to maintain temperature in the forward section wall member 170 which is subject to cooling via impingement of relatively cool air or other fluid from cool air tubes 126 discussed in more detail below, attached to the forward portion of upper wall member 140. Bleed air baffle 182, which extends across the full width of lower wall member 170 and which is attached to side wall 76 at regular intervals by means of screws 188 and spacers 186, prevents air from tubes 126 or slot 115 from being entrained by bleed air from vents 174. Baffle wier 184 creates slight backpressure downstream of vents 174, within cavity 180, which prevents air from tubes 126 or slot 115 from being entrained via small unintended and undesirable gaps between baffle 182 and lower wall member 170. Baffle 182 need extend only sufficiently far from wall member 170 to prevent significant interaction between bleed air from vents 174 and air from tubes 126 or slot 115.

As seen in FIGS. 1, 2, 5 and 7 of the drawings, discharge slot 115 of the second manifold housing 56 is provided with a plurality of tubes 126, preferably uniformly spaced along the forward edge of wall member 140, which communicate at roughly a right angle to the axis of discharge slot 115. These tubes 126 direct individual streams of pressurized, relatively cool fluid, for example, air having a pressure of at least about 1 to 10 times the pressure of the air exiting slot 115 and a temperature substantially below that of the heated air in chamber 166, transversely past discharge slot 115 to selectively divert and diffuse or dilute the flow of heated air over selected segments at selected points along the length of slot 115 in accordance with pattern control information. As seen in FIG. 1, pressurized unheated air is supplied to each of the tubes 126 from compressor 38 by way of a master control valve 128, pressure regulator valve 129, air line 130, and unheated air header pipe 132 which is connected by a plurality of individual air supply lines 134 to the individual tubes 126. Each of the individual cool air supply lines 134 is provided with an individual control valve located in a valve box 136. These individual control valves are operated to open or close in response to signals from a pattern control device, such as a computer 138, to deflect and dilute selected intervals or segments of the curtain of hot air at selected locations outside and along the length of slot 115 during movement of the fabric and thereby produce a desired pattern in the fabric. Adjacent tube spacing along the length of slot 115 is sufficiently close to avoid any leakage of heated air from between two adjacent positions of tubes 126 when such tubes are fully activated, thereby allowing the width of the individual segment or segments which are diverted or diluted to be a pattern variable. It is foreseeable that, for certain pattern effects, controlled "leakage" of heated gas through or between the cool air streams produced by individual or adjacently positioned tubes 126 may be desirable. This can be achieved by, for example, reducing or modulating the pressure of the air in selected ones of tubes 126 while said selected tubes 126 are supplying diverting air streams. Detailed patterning information for individual patterns may be stored and accessed by means of any known data storage medium suitable for use with electronic computers, such as paper or magnetic tape, EPROMS, etc.

As depicted in FIGS. 2, 5, and 7, tubes 126 are positioned immediately in front of discharge slot 115, with the mouth of each tube 126 being positioned in alignment along a line parallel to slot 115 and slightly above the forward edge of upper wall member 140 which forms the mouth of discharge slot 115. Cooling means such as a cold water manifold is not required to prevent excessive heating of the air in tubes 126, for several reasons. Tubes 126, being mounted externally to upper wall member 140, are not subject to as much heating from upper wall member 140 as might be experienced where tubes 126 are in more direct contact with member 140. Additionally, because the air from tubes 126 does not contact directly the substrate surface, but rather serves to divert and dilute the heated air from slot 115, rather than block such air, incidental heating of the air in tubes 126 can be more easily accommodated with little or no effect in the resulting patterning. To facilitate secure, proper positioning and alignment of tubes 126, each tube may be secured to a block 143 by means of brazing, ceramic adhesive, or other means. Block 143 in turn may be detachably secured to upper wall member 140 by means of screws 144 or other means. The exact position of the mouths of tubes 126 in relation to the stream of air exiting slot 115 may be adjusted by means of, for example, shims inserted between mating surfaces of block 143 and wall member 140. Optimum positioning of the mouths of tubes 126 depends of course upon the dimensions of tubes 126 and slot 115, as well as the respective pressures of the exiting curtain of heated air and the relatively cool diverting air streams, among other things. It has been found, for a slot thickness of 0.015 to 0.025 inch, a tube inside diameter of 0.033 inch, a tube outside diameter of 0.0042 inch, a tube spacing (from tube centerline to adjacent tube centerline) of 0.05 inch, a heated air pressure of 0.5 p.s.i.g. and a cool air pressure of 3 p.s.i.g., positioning the mouths of tubes 126 approximately 0.025 to 0.100 inch above the upper edge of slot 115 (i.e.., above the lower edge of wall member 140) is satisfactory, although other configurations and spacings may be advantageous under certain circumstances. It is generally recommended that the rearward portion of the interior walls of tubes 126 be mounted in the same plane as the forward edge of wall member 140, so that the forward edge of wall member 140 serves as an extension of a portion of the interior walls of tubes 126. In this particular case, therefore, the central axis of the tubes 126 may be positioned approximately 0.0175 inches (exactly one tube bore radius) from the forwardmost edge of wall member 140. It should be understood, however, that other positions for tubes 126 may be found to be satisfactory, and may be superior, for this or other combinations of air temperatures and pressures, slot thicknesses, etc. It is also foreseen that tubes 126 preferably may be flared rather than having a uniform bore, depending upon conditions.

Figure 9:
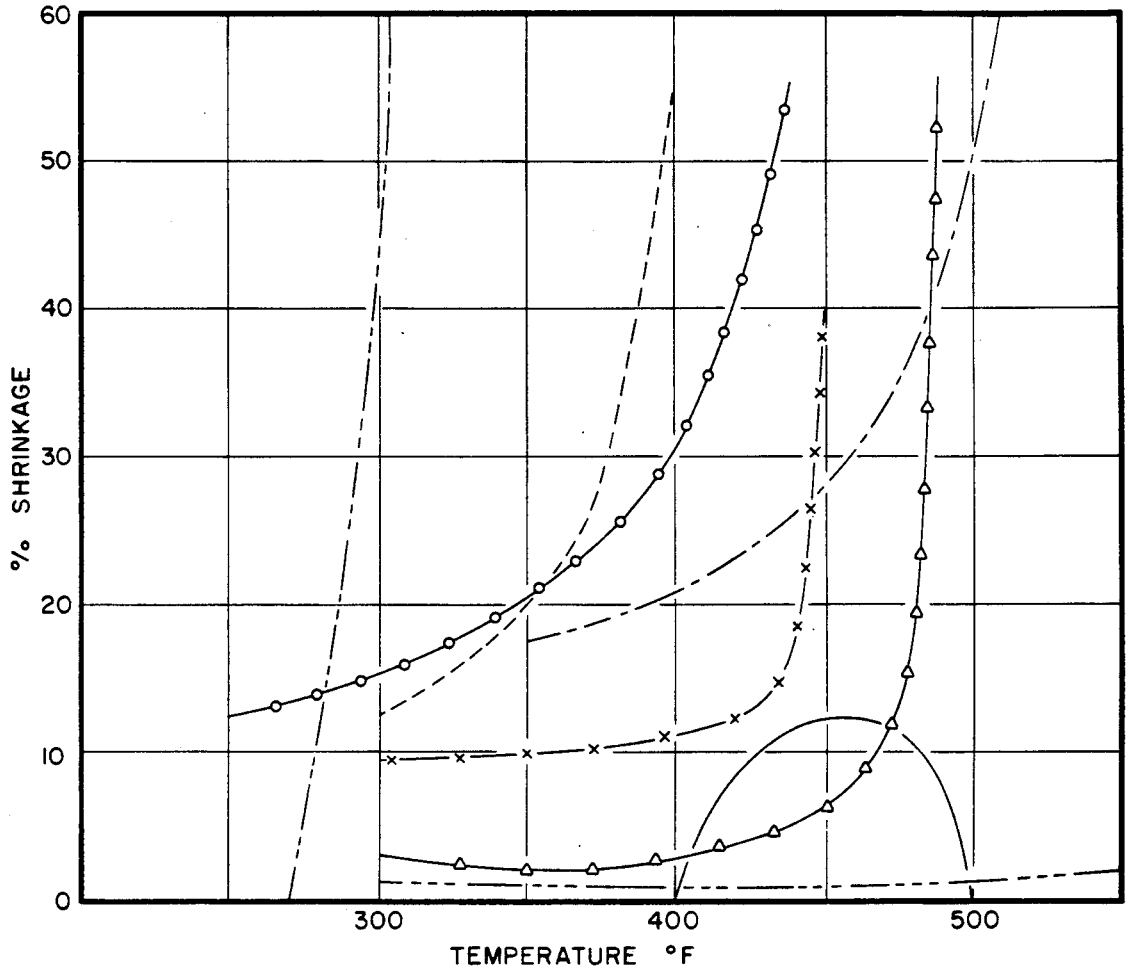
FIG. 9 is a diagram of shrinkage vs. temperature (experimentally determined) for several thermally modifiable substrate constituent fibers.

In operation, heated air generated by heaters 44 flow through inlet openings 82, and is directed through compartment 81 to passageways 86 and elongate channel 88. Upon entering fluid receiving compartment 160, the heated air is directed through a series of chambers and gaps intended to assure the air exiting compartment 160 is totally uniform with respect to temperature, pressure, and velocity. Upon exiting compartment 160, including chambers 162 and 166, the air exits via slot 115 as a thin blade or curtain of heated air, directed onto a moving substrate positioned opposite and in close proximity to the mouth of slot 115. The exact spacing between the mouth of slot 115 and the substrate surface is dependent upon the visual effect desired on the substrate, the nature of the substrate, and other factors. The spacing is of course limited by the space occupied by the tubes 126 and any mounting means associated with the tubes. Generally speaking, the distance between the mouth of slot 115 and the top-most portion of substrate 12 will be between about 0.040 inch and about 0.25 inch under ordinary conditions, although spacings outside this range are possible. Selected intervals or lateral segments of this curtain of heated air may be diverted and diluted by relatively cool, high pressure air, directed substantially perpendicularly to the plane of the heated air curtain from tubes 126. The lateral segments which are not diverted are permitted to strike the substrate surface and induce a visual change in the surface thereby. The selected lateral segments diverted by the relatively cool air streams from tubes 126 either strike the substrate obliquely or not at all; in either case, the segments are diluted or diffused to such an extent that no substantial visual effect is produced.

Where the resulting streams of heated air are maintained at a sufficiently high temperature and directed onto a substrate comprised of a thermally modifiable material, for example, thermoplastic materials such as polyester, polyamide, polyolefin, or acrylonitrile fibers or yarns, substantial longitudinal shrinkage of individual fibers or yarns, as well as localized melting or fusing of individual fibers or yarns, or other thermally induced changes in the physical character and visual appearance of the material, can be induced. Such shrinking or melting or fusing can in turn result in the permanent patterning of the substrate by, for example, causing sculpturing or puckering of the substrate, or by creating a visual contrast between treated and untreated areas, either with or without an additional, post-treatment dyeing step. Suggested temperatures on the substrate at which shrinkage of various substrate constituents occurs is given in FIG. 9.

The following examples describe further details of the invention disclosed herein.

EXAMPLE I

A knit polyester plush pile fabric having a weight of thirteen ounces per square yard and a pile height of one tenth of an inch was continuously fed through the apparatus illustrated in FIG. 1 at a speed of fabric travel of three and one-half yards per minute. The temperature and pressure of the heated air in the manifold compartment 81 was maintained at 620° F. and 0.37 p.s.i.g., respectively. The height (gap) of slot 115 was 0.018 inch and the distance between the mouth of slot 115 and the fabric was set at 0.08 inch. The deflecting air jet tubes 126 were set 0.050 inch above slot 115 and were spaced apart along the upper lip of the manifold 56 with the forward-most portion of member 170 aligned with the inside edge of the tube bore. The tubes were made from 0.027 inch inside diameter hypodermic tubes 4 inches long, bored out 0.033 inch×0.125 inch deep at the discharge end. The bore of the tube just contacted the upper lip of manifold 56. The deflecting air pressure through tubes 126, measured prior to the solenoid valves controlling deflecting air flow, was set at 3 p.s.i.g. The treated fabric possessed a pattern composed of longitudinally shrunken fibers where the hot air had been allowed to contact the fabric.

EXAMPLE II

A polyester plain weave fabric having a fabric weight of three and one-half ounces per square yard, and a 92 warp end by 84 picks per inch fabric construction, was processed through the apparatus of FIG. 1 at a fabric speed of four yards per minute. The temperature and pressure of the heated air in the manifold compartment 81 was maintained at 690° F. and 0.8 p.s.i.g., respectively. The height (gap) of slot 115 was 0.018 inch and the distance between the mouth of slot 115 and the fabric was set at 0.08 inch. The deflecting air jet tubes 126 were set 0.050 inch above slot 115 and were spaced along the upper lip of manifold 56 with the forward-most portion of member 170 aligned with the inside edge of the tube bore. The tubes were made from 0.027 inch inside diameter hypodermic tubes 4 inches long, bored out 0.033 inch×0.125 inch deep at the discharge end. The bore of the tube just contacted the upper lip of manifold 56. The deflecting air pressure through tubes 126, measured prior to the solenoid valves controlling deflecting air flow, was set at 4.5 p.s.i.g. The treated fabric possessed a pattern composed of longitudinally shrunken fibers where the hot air had been allowed to contact the fabric.

I claim:

1. A method for treating a moving substrate travelling in a well-defined path by application of pressurized heated gas to the surface of said substrate to modify thermally the surface appearance of said substrate and impart a visual pattern thereto, comprising the steps of:

(a) generating an elongate reservoir of uniformly heated pressurized gas extending across the path of said substrate;

(b) fixing the relative position of said substrate path in spaced but closely adjacent relation to said reservoir;

(c) forming, within said reservoir, a thin, elongate uninterrupted sheet of a gas stream said stream, extending substantially continuously along the length of said reservoir and across the path of said substrate;

(d) projecting said stream directly and uniformly from said reservoir in a continuous and uninterrupted curtain of heated gas extending along the length of said reservoir in the direction of said substrate surface;

(e) diverting and diluting in a direction away from said substrate surface, a precisely defined lateral segment of said uninterrupted continuous curtain projecting from said reservoir at at least one location along the length of said reservoir after said curtain leaves said reservoir by means of a relatively cool gas stream, thereby preventing areas of said substrate surface opposite said diverted lateral segment of said curtain from being squarely impinged in accordance with pattern information and thermally modified by said segment of said heated gas curtain while other lateral segments of said curtain are projected onto areas of said substrate surface and squarely impinge on said surface;

(f) maintaining the temperature of said heated gas stream at a uniform level along the length of said reservoir, said level being sufficient to enable said lateral segments of said curtain squarely impinging on said surface to modify thermally said surface appearance of said substrate; and (g) moving said substrate on said path and into said stream projecting from said reservoir.

2. The method of claim 1, wherein said lateral segment is diverted by a plurality of relatively cool gas streams aligned along the length of said reservoir, at least two of said relatively cool air streams being adjacently spaced to divert and dilute substantially all of said curtain within the region along that length of said reservoir defined by said adjacent cool air streams.

3. The method of claim 2, wherein the axis of said cool gas stream is oriented at approximately a 90° angle from the direction in which said heated curtain is projected.

4. The method of claim 1, wherein said diverting of said lateral segment of said curtain is intermittent and for a predetermined duration, said duration being determined by pattern information continuously supplied at the same time said substrate is moving across the path of said projecting curtain.

5. The method of claim 4, wherein selected segments of said uninterrupted heated gas curtain are selectively diverted to impart a surface pattern effect which varies irregularly along the length of fabric movement.

6. The method of claim 1, wherein said substrate contains thermoplastic yarns, and wherein the temperature and pressure of said heated gas segments squarely impinging said substrate are maintained at a sufficient level to longitudinally shrink said thermoplastic yarns contacted thereby.

7. Apparatus for treating a relatively moving substrate by application of pressurized heated gas to selected surface portions thereof to thermally modify and alter the visual surface appearance of the substrate, comprising a manifold, means for supplying heated gas under pressure to the manifold, said manifold having a narrow, elongate, and uninterrupted gas discharge slot extending along the length of said manifold for initially projecting a continuous curtain of uniformly heated gas through said slot in the direction of said substrate surface, means for selectively diverting at least one lateral segment of said heated gas curtain projected from the slot at a selected location outside and along the length of said slot so as to prevent the gas from impinging squarely on the substrate at a corresponding location on the substrate surface comprises means outside said manifold for selectively directing a stream of cooler pressurized gas perpendicular to said slot and across the path of said curtain at least at one selected location along the length of said slot, and means for supporting the substrate and effecting relative movement of the substrate past the slot at a location such that the substrate is impinged on squarely by that portion of said continuous curtain which is undiverted by said diverting means.

8. The apparatus of claim 7, wherein said elongate manifold is comprised of a first and a second elongate manifold housings secured in gas tight relationship therewith, said first manifold housing defining a gas flow path into said second manifold housing which is substantially perpendicular to the path of gas being projected from said second manifold housing in the direction of said substrate.

9. Apparatus according to claim 7, wherein the means for selectively directing said cooler gas includes a plurality of individual orifices, aligned in parallel with said slot, each orifice being associated with individual valve means to permit the initiation or interruption of a flow of pressurized cooler gas in accordance with pattern information continuously supplied to said valve means.

10. The apparatus of claim 9, wherein said individual value means is associated with a pattern information source means which supplies such pattern information to said individual value means automatically.

11. The apparatus of claim 9, wherein said means for selectively directing said cooler gas comprises a plurality of individual tubes with individual valve means associated therewith, said tubes arranged in alignment along the outside of said slot and having a bore axis which is substantially perpendicular to the discharge axis of said slot.

* * * * *